United States Patent [19]

Gibson et al.

[11] 4,231,795

[45] Nov. 4, 1980

[54] HIGH WELDABILITY NICKEL-BASE SUPERALLOY

[75] Inventors: Robert C. Gibson, Ringwood, N.J.; Michael K. Korenko, Richland, Wash.

[73] Assignee: The United States of America as represented by the United States Department of Energy, Washington, D.C.

[21] Appl. No.: 917,833

[22] Filed: Jun. 22, 1978

[51] Int. Cl.[2] ..... C22C 19/05

[52] U.S. Cl. ..... 75/171; 176/91 R; 176/92 B

[58] Field of Search ..... 75/171, 122, 134 F; 176/91 R, 92 B

[56] References Cited

U.S. PATENT DOCUMENTS

| | | | |
|---|---|---|---|
| 2,994,605 | 8/1961 | Gill et al. | 75/171 |
| 3,160,500 | 12/1964 | Eiselstein et al. | 75/171 |
| 3,598,578 | 8/1971 | Wang | 75/171 |
| 3,705,827 | 12/1972 | Muzyka et al. | 75/171 |
| 3,865,581 | 2/1975 | Sekino et al. | 75/122 |
| 3,972,752 | 8/1976 | Honnorat | 75/171 |

*Primary Examiner*—Arthur J. Steiner
*Attorney, Agent, or Firm*—R. A. Stoltz

[57] ABSTRACT

This is a nickel-base superalloy with excellent weldability and high strength. Its composition consists essentially of, by weight percent, 10–20 iron, 57–63 nickel, 7–18 chromium, 4–6 molybdenum, 1–2 niobium, 0.2–0.8 silicon, 0.01–0.05 zirconium, 1.0–2.5 titanium, 1.0–2.5 aluminum, 0.02–0.06 carbon, and 0.002–0.015 boron. The weldability and strength of this alloy give it a variety of applications. The long-time structural stability of this alloy together with its low swelling under nuclear radiation conditions, make it especially suitable for use as a duct material and controlling element cladding for sodium-cooled nuclear reactors.

5 Claims, No Drawings

HIGH WELDABILITY NICKEL-BASE SUPERALLOY

This invention was made in the course of, or under, a contract with the U.S. Department of Energy.

CROSS-REFERENCE TO RELATED APPLICATION

A nickel-based superalloy which also exhibits long-time structural stability and low swelling under nuclear radiation conditions is described in related Application Ser. No. 917,832, assigned to the same assignee. Although this related alloy has less nickel and somewhat poorer physical properties than this invention, this related alloy has a much lower neutron cross-section and can be used as fuel cladding or structural elements within the reactor core generally, whereas in-reactor usage of the alloy of this invention is limited to uses such as control element assemblies where low neutron cross-section is not required.

BACKGROUND OF THE INVENTION

The present invention relates to nickel-based superalloys.

A typical prior art alloy is described in U.S. Pat. No. 3,160,500, issued to Eiselstein. It discloses nickel-chromium base alloys which have a good combination of mechanical properties over a wide range of temperature. Specifically, the aforesaid patent discloses a nickel-based alloy having a weight percent composition of about 55–62 nickel, 7–11 molybdenum, 3–4.5 columbium, 20–24 chromium, up to 8 tungsten, not more than 0.1 carbon, up to 0.05 silicon, up to 0.05 manganese, up to 0.015 boron, not more than 0.4 of aluminum and titanium, and the balance essentially iron, with the iron content not exceeding about 20% of the alloy. Inconel 625 is a commercial embodiment of the above Eiselstein patent.

The alloy described in U.S. Pat. No. 3,046,108, also issued to Eiselstein, has a nominal composition of about 53 nickel, 19 chromium, 3 molybdenum, 5 niobium, 0.2 silicon, 0.2 manganese, 0.9 titanium, 0.45 aluminum, 0.04 carbon and the balance essentially iron. These Eiselstein patents are similar in some respects, but the second teaches, for example, much lower molybdenum.

While the mechanical properties at high temperatures of alloys such as those described above are suitable for many purposes, such alloys are generally difficult to weld and, tend to swell when subjected to nuclear radiation.

SUMMARY OF THE INVENTION

It has been discovered that nickel-based superalloys having a combination of high strength, high stability and high weldability can be obtained by the use of certain critical narrow ranges of composition. Especially critical are the concentrations of titanium, niobium, aluminum and molybdenum. Further, certain zirconium and boron concentrations protect the grain boundaries and therefore tend to reduce swelling under nuclear irradiation. Silicon also reduces the swelling from nuclear irradiation and, contrary to the prior art, silicon is preferably used amounts greater than ½%.

Specifically, the alloy of this invention consists essentially of (by weight percent) 57–63 nickel, 7–18 chromium, 4–6 molybdenum, 1–2 niobium, 0.2–0.8 (and preferably more than 0.5) silicon, 0.1–0.05 zirconium, 1–2.5 titanium, 1–2.5 aluminum, 0.02–0.06 carbon, 0.002–0.015 boron and the balance essentially iron, with the iron content being 10–20.

DESCRIPTION OF THE PREFERRED EMBODIMENTS

The original objective of this work was to produce new solid solution and precipitation hardened nickel-chromium-iron alloys which were stable, low swelling and resistant to in-reactor plastic deformation. Testing indicated that the best commercially available material was Inconel 625 but that swelling under irradiation could be a problem. The alloys of this invention were developed in an effort to reduce swelling. These particular alloys, however, exhibited especially good strength and weldability, and thus are also attractive for non-nuclear applications.

These alloys are high nickel, gamma prime hardened alloys and have improved strength, swelling resistance, structural stability and weldability, as compared to the prior art alloys such as Inconel 625. Table 1, below, shows the composition of two alloys of this invention on which extensive testing was performed.

TABLE I

| | ALLOY COMPOSITION (WEIGHT PERCENT) | | | | | | | | | | |
|---|---|---|---|---|---|---|---|---|---|---|---|
| Alloy No. | C | Si | Ni | Cr | Fe | Mo | Nb | Al | Ti | B | Zr |
| D41 | .03 | .5 | Bal | 8 | 22.5 | 5 | 1.5 | 2 | 2 | .01 | .03 |
| D42 | .03 | .5 | Bal | 15 | 15.5 | 5 | 1.5 | 1.5 | 1.5 | .01 | .03 |

These alloys were vacuum induction melted and cast as 100 pound ingots. Following surface conditioning, the alloys were charged into a furnace, heated to 1093° C. and then soaked for two hours prior to hot rolling to 2½×2½ inch square billets. Portions of the billets were then hot-rolled into ½ inch thick plate.

Samples were then subjected to various treatments. The resulting tensile properties are listed in Table II. The ultimate strength of Inconel 625 is only about 103 ksi at 650° C., and it can be seen that the D42 (with an ultimate strength of over 150 ksi at 650° C. with treatment No. 5, for example) is far superior. The highest strengths were realized for treatments No. 4 and No. 5. Control over the warm working treatment (treatment No. 4), was difficult due to the very rapid chilling of the thin sheet upon contact with the rolls, and treatment No. 5 was therefore chosen for stress rupture tests rather than treatment No. 4. Treatment No. 2 was also selected for stress rupture testing and both results are shown in Table III. It should be noted that the estimated 1000 hour rupture strengths are only estimates and that due to the limited number of tests on alloy D42 (treatment No. 5) both the 100 hour and 1000 hour rupture strengths strengths should be treated as estimates for this alloy. The 100 hour stress rupture strength of Inconel 625 at 650° C. is only about 62, and it can be seen that D42 (e.g. 74 with treatment No. 5) is significantly better.

TABLE II

TENSILE PROPERTIES OF ALLOYS D41 AND D42

| No. | Treatment | Test Temperature (°C.)(°C.)(K.) | Alloy D41 .2% YS (ksi) | Alloy D41 UTS (ksi) | Alloy D41 El. (%) | Alloy D42 .2% YS (ksi) | Alloy D42 UTS (ksi) | Alloy D42 El. (%) |
|---|---|---|---|---|---|---|---|---|
| 1 | 1 hr/1038° C. + 11 hr/800° C. | RT | 124.8 | 187.1 | 17.0 | 114.3 | 176.3 | 21.5 |
| | + 2 hr/700° C. | 550 | 120.9 | 167.1 | 9.5 | 106.9 | 120.3 | 1.0 |
| | | 600 | 119.4 | 136.8 | 1.5 | 104.9 | 159.4 | 10.5 |
| | | 650 | 118.2 | 138.4 | 2.0 | 106.2 | 136.7 | 6.0 |
| 2 | 1 hr/926° C. + 11 hr/800° C. | RT | 160.3 | 202.6 | 10.0 | 153.5 | 192.7 | 14.5 |
| | + 2 hr/700° C. | 550 | 140.4 | 187.8 | 6.5 | 151.6 | 189.0 | 5.0 |
| | | 600 | 138.6 | 176.9 | 9.0 | 125.9 | 169.3 | 13.0 |
| | | 650 | 110.3 | 147.2 | 11.0 | 122.6 | 152.5 | 15.0 |
| 3 | .25 hr/1038° C. + 1 hr/899° C. | RT | 116.9 | 180.6 | 18.0 | 109.3 | 176.0 | 16.5 |
| | + 8 hr/749° C. | 550 | 110.5 | 169.8 | 7.5 | 90.0 | 152.9 | 23.0 |
| | | 600 | 111.8 | 148.7 | 3.0 | 89.6 | 148.3 | 18.0 |
| | | 650 | 111.9 | 135.7 | 3.0 | 89.8 | 135.3 | 22.0 |
| 4 | 30% warm work (1038° C.) | RT | 160.0 | 197.2 | 12.0 | 150.0 | 182.4 | 13.5 |
| | + 11 hr/800° C. + 2 hr/700° C. | 550 | 142.6 | 185.8 | 9.5 | 138.5 | 176.9 | 10.0 |
| | | 600 | 140.3 | 176.6 | 9.0 | 136.5 | 173.1 | 15.0 |
| | | 650 | 122.6 | 153.1 | 8.5 | 127.9 | 154.6 | 7.0 |
| 5 | 30% cold work + 11 hr/800° C. | RT | 185.9 | 216.7 | 9.0 | 168.3 | 198.4 | 10.0 |
| | + 2 hr/700° C. | 550 | 159.1 | 202.6 | 5.5 | | | |
| | | 600 | 146.7 | 188.9 | 14.0 | | | |
| | | 650 | 122.9 | 158.9 | 17.0 | 125.5 | 156.4 | 17.0 |
| 6 | 1 hr/1038° C. + 11 hr/800° C. | RT | 230.1 | 244.0 | 1.0 | 212.7 | 245.3 | 1.0 |
| | + 2 hr/700° C. + 30% cold work | 550 | 152.8 | 211.6 | 3.0 | 158.8 | 206.7 | 1.0 |
| | | 600 | 142.1 | 191.0 | 7.0 | 116.0 | 178.5 | 0.5 |
| | | 650 | 96.2 | 152.2 | 11.0 | 89.6 | 146.0 | 16.5 |

TABLE III

STRESS RUPTURE PROPERTIES OF ALLOYS D41 AND D42

| Alloy | Treatment | Test Temperature (° C.) | Rupture Strength 100-hr. | Rupture Strength Est. 1000-hr. |
|---|---|---|---|---|
| D41 | 1 hr/927° C. + 11 hr/800° C. | 650 | 70 | 55 |
| | + 2 hr/700° C. (#2) | 600 | 90 | 73 |
| | | 550 | 120 | 105 |
| D42 | 1 hr/927° C. + 11 hr/800° C. | 650 | 73 | 62 |
| | + 2 hr/700° C. (#2) | 600 | 97 | 80 |
| | | 550 | 138 | 125 |
| D41 | 30% cold work | 650 | 75 | 54 |
| | + 11 hr/800° C. | 600 | 105 | 82 |
| | + 2 hr/700° C. (#5) | 550 | 135 | 110 |
| D42 | 30% cold work | 650 | 74 | 58 |
| | + 11 hr/800° C. | 600 | 95 | 72 |
| | + 2 hr/700° C. (#5) | 550 | 131 | 115 |

The room temperature tensile properties following a stability exposure treatment (30% cold work+200 hours at 700° C.) are shown in Table IV. It can be seen that the alloys show similar strength and ductility. The microstructures were examined after exposure at 700° C. For alloy D41, a duplex gamma-prime size distribution was developed. Alloy D42 showed a finer gamma prime dispersion. No evidence of any acicular phase was observed in the microstructure of either of these alloys.

TABLE IV

ROOM TEMPERATURE TENSILE PROPERTIES FOLLOWING STABILITY TREATMENT

| Alloy | Treatment | .2% YS (ksi) | UTS (ksi) | % El. |
|---|---|---|---|---|
| D41 | 30% CW + 200 hr/700° C. | 194.4 | 225.3 | 5.0 |
| D42 | 30% CW + 200 hr/700° C. | 191.1 | 215.9 | 7.5 |

As noted previously, alloys for use in non-nuclear applications or for control assembly applications can be designed having higher nickel ranges than alloys which are designed for nuclear fuel cladding (where neutron absorption is important). While higher nickel alloys such as Inconel 625 could be used in applications where neutron absorption is not important, the alloys of this invention proved to have advantages, and in particular, to have lower swelling, greater strength and, as noted below, better weldability.

Macro-etched micrographs of both D41 and D42 revealed that both alloys produced sound ductile welds. Bend tests revealed, however, that alloy D42 welds were approximately 50% more ductile than those of alloy D41. The advantage of a higher ductility weld, coupled with the fact that D42 relies more heavily on solid solution strengthening than D41, results in alloys in the range of D42 being preferred. The weldability problems common to Inconel 625 have not been encountered with the D42 alloy.

It is felt that the silicon acts as a swelling inhibitor and, especially in nuclear applications, the silicon content is preferably at least 0.5% and indications are that the optimum silicone is greater than 0.5%. It is also believed that the molybdenum content contributes to a Laves phase (which adversely affects strength and increases swelling) and that, especially in reactor applications, the molybdenum content is preferably less than 5%. The zirconium and boron content are thought to be important in the protection of grain boundaries and may reduce swelling in reactor applications. The boron content is preferably not less than 0.01 and the zirconium content is preferably not less than 0.03.

It is felt that the greatly enhanced weldability is due to the lower titanium, niobium and aluminum contents of these alloys. Preferably the titanium content is not greater than 1.5%, the aluminum not greater than 1.5% and the niobium not greater than 1.5%.

Thus, it can be seen that an alloy with a composition by weight of 57–63 nickel, 17–18 chromium, 4–6 molybdenum, 1–2 niobium, 0.2–0.8 silicon, 0.01–0.05 zirconium, 1.0–2.5 titanium, 1.0–2.5 aluminum, 0.02–0.06 carbon, 0.002–0.015 boron, and the balance essentially iron (10–20) has excellent weldability characteristics and is stronger than commercially available alloys such as Inconel 625. In addition, its long-time structural stability due to its low swelling characteristics make it especially adapted for use in control element assemblies and ducting in sodium cooled nuclear reactors.

The invention is not to be construed as limited to the particular forms described herein, since these are to be regarded as illustrative rather than restrictive. The invention is intended to cover all compositions which do not depart from the spirit and scope of the invention.

What we claim is:

1. A nickel base alloy consisting essentially of, by weight percent, 57–63 Ni, 7–18 Cr, 10–20 Fe, 4–6 Mo, 1–2 Nb, 0.2–0.8 Sl, 0.01–0.05 Zr, 1.0–2.5 Ti, 1.0–2.5 Al, 0.02–0.06 C and 0.002–0.015 B, said alloy being characterized by a combination of long-term structural stability, strength and excellent weldability.

2. The alloy of claim 1 wherein the titanium is not greater than 1.5, the aluminum is not greater than 1.5, and the niobium is not greater than 1.5.

3. The alloy of claim 2, wherein the silicon is greater than 0.5.

4. The alloy of claim 3 wherein the molybdenum is not greater than 5.

5. The alloy of claim 1 wherein the boron is not less than 0.010, the zirconium is not less than 0.03.

* * * * *